US006386159B1

(12) United States Patent
Roberts

(10) Patent No.: US 6,386,159 B1
(45) Date of Patent: May 14, 2002

(54) VALVE TIMING SYSTEM

(76) Inventor: Frederick William Roberts, 33 Young Street, Quirindi NSW 2343 (AU)

( * ) Notice: Subject to any disclaimer, the term of this patent is extended or adjusted under 35 U.S.C. 154(b) by 0 days.

(21) Appl. No.: 09/171,363

(22) PCT Filed: Apr. 16, 1997

(86) PCT No.: PCT/AU97/00237

§ 371 Date: Oct. 30, 1998

§ 102(e) Date: Oct. 30, 1998

(87) PCT Pub. No.: WO97/39222

PCT Pub. Date: Oct. 23, 1997

(30) Foreign Application Priority Data

Apr. 16, 1996 (AU) ..... PN9265

(51) Int. Cl.[7] ..... F01L 1/04; F01L 13/00

(52) U.S. Cl. ..... 123/90.16; 123/90.17; 123/90.48

(58) Field of Search ..... 123/90.15, 90.16, 123/90.17, 90.18, 90.28, 90.48

(56) References Cited

U.S. PATENT DOCUMENTS 4,570,581 A * 2/1986 Titolo ..... 123/90.18
4,693,214 A * 9/1987 Titolo ..... 123/90.18
4,850,311 A * 7/1989 Sohn ..... 123/90.18
4,869,215 A * 9/1989 Parsons ..... 123/90.16
5,111,781 A * 5/1992 Kaku et al. ..... 123/90.16

FOREIGN PATENT DOCUMENTS

| | | |
|---|---|---|
| DE | 3503740 | 8/1986 |
| EP | 0713958 | 5/1996 |
| GB | 2165018 | 4/1986 |
| GB | 2207968 | 2/1989 |

* cited by examiner

*Primary Examiner*—Weilun Lo
(74) *Attorney, Agent, or Firm*—Norris, McLaughlin & Marcus P.A.

(57) ABSTRACT

A variable valve timing system applicable for varying the opening and closing cycle of the inlet and outlet valves of an internal combustion engine. The system comprises a cam follower and a cam which is rotated about the cam shaft to move the valve between its open and closed position. To vary the cycle of the opening and closing valves, a rotational means is connected to the cam follower to rotate the cam follower such that the cam follower and cam are out of alignment such that the cam lobe engages the contact surface at a higher point and hence earlier than if the cam follower and the cats are aligned. Therefore the valve is opened sooner and closed later, increasing the degrees of cycle for which the valve is open, for example, as the engine revolutions increase.

4 Claims, 6 Drawing Sheets

VALVE TIMING SYSTEM

BACKGROUND OF THE INVENTION

The present invention relates to a power output improvement apparatus for an internal combustion engine and in particular to a valve timing system for an internal combustion engine, which is also applicable to engines having multi-inlet and multi-exhaust configurations per combustion chamber.

Many systems have been developed to increase the power output of internal combustion engines. Some of these utilise multiple valves, and variable valve timing such as BMW's patented Vanos variable valve timing system.

SUMMARY OF THE INVENTION

The present invention provides a variable valve timing system comprising:

a cam follower adapted to move the valve between its closed and open position, said follower having a contoured engagement surface;

a cam, located on and driven by a cam shaft, and having a contact surface adapted to engage the engagement surface of the cam follower and move the cam follower to operate the valve, the contact surface of the cam being contoured at least along a portion thereof; and rotational means to rotate the cam follower relative to the plane of movement of the cam such that the contoured contact surface of the cam and contoured engagement surface of the cam follower engage each other earlier and disengage later than if the cam follower is not rotated.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
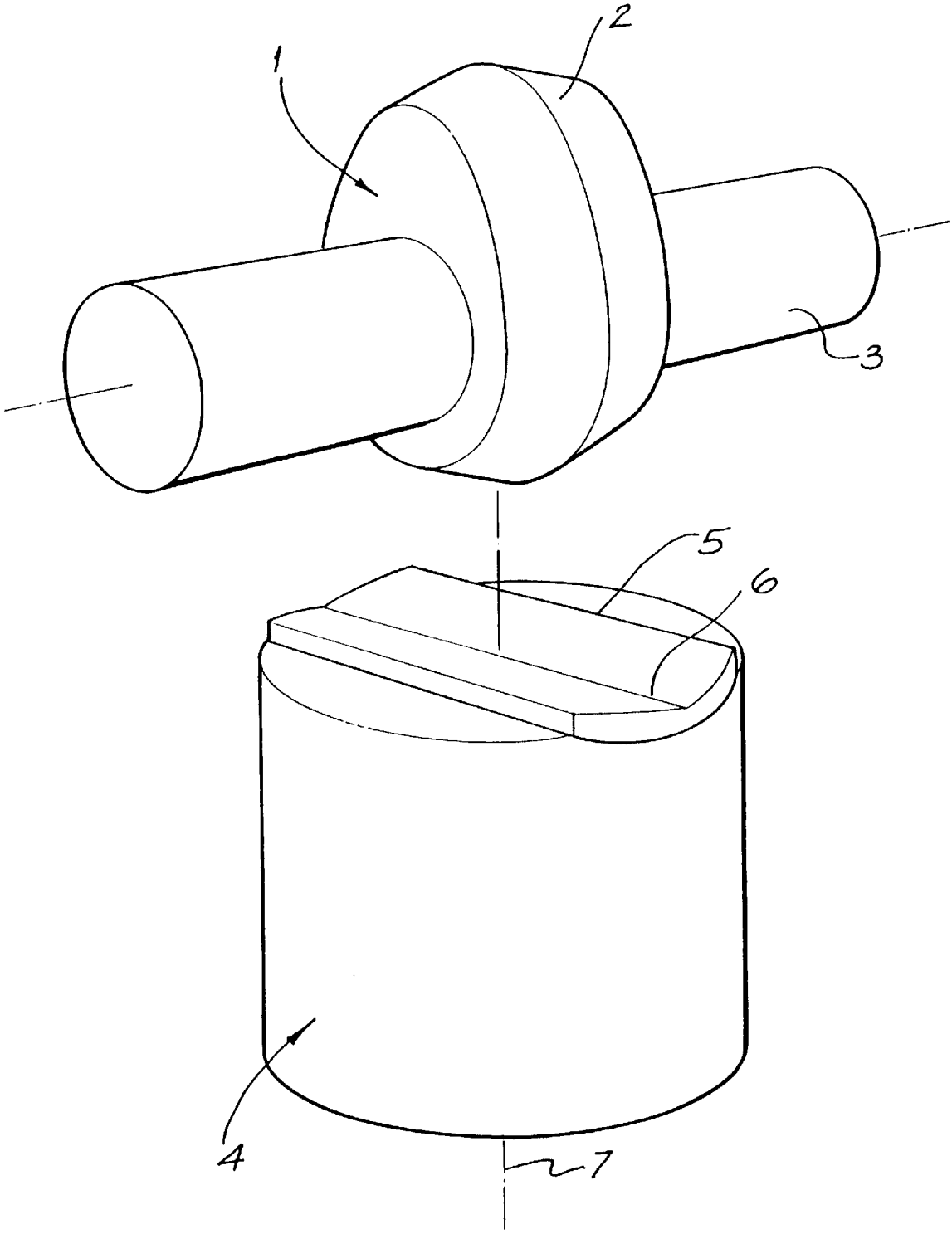
FIG. 1 illustrates schematically a perspective view of a cam and cam follower of one embodiment of the present invention.

In one embodiment of the present invention, as shown in FIG. 1, the cam (1) has a contoured outer or contact surface

(2). The contour can be of any desired profile, but is preferably v-shaped. The cam (1) is supported on the cam shaft (3) as is normal with internal combustion engines.

The cam follower (4) operates the valve (not shown), and has a contoured upper engagement surface (5) of any desired configuration. However preferably the contour of the upper engagement surface (5) of the cam follower (4) and the contoured contact surface (2) of the cam (1) are complementary. In the present embodiment the contour on the upper surface (5) of the cam follower (4) is a v-shaped recess (6), with the walls thereof at any desired angle.

The general operation of the timing system of the present invention is the same as any standard timing system, in that as the cam shaft rotates at a speed determined by the engine speed such as at half the engine speed, the cam rotates around the cam shaft axis and the cam engagement surface on the lobe engages the cam follower, opening and closing the valve.

Figure 3:
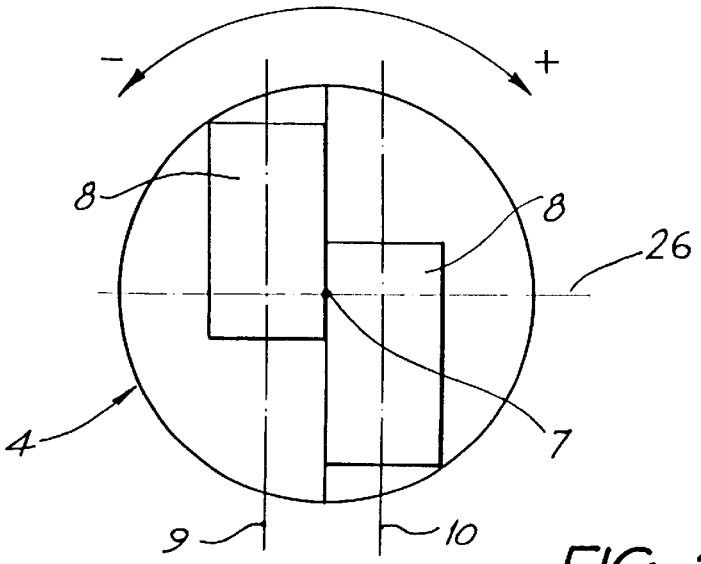
FIG. 3 illustrates schematically a plan view of the cam follower shown in FIG. 2.
Figures 4, 4A, 4B:
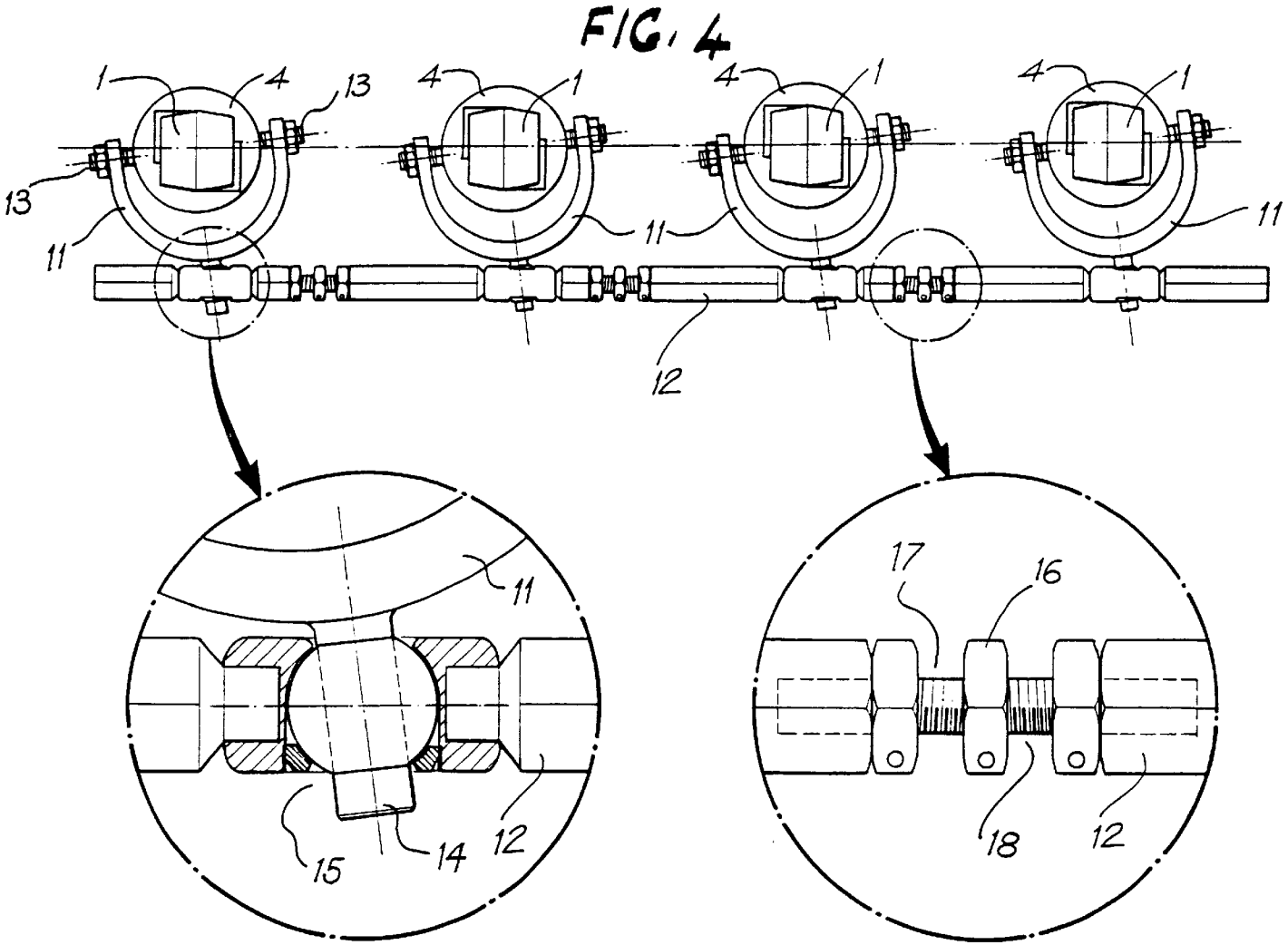
FIG. 4 illustrates schematically a control rod assembly controlling four cam followers as illustrated in FIG. 3.
FIGS. 4A and 4B show close-up portions of FIG. 4 as indicated.
Figure 5:
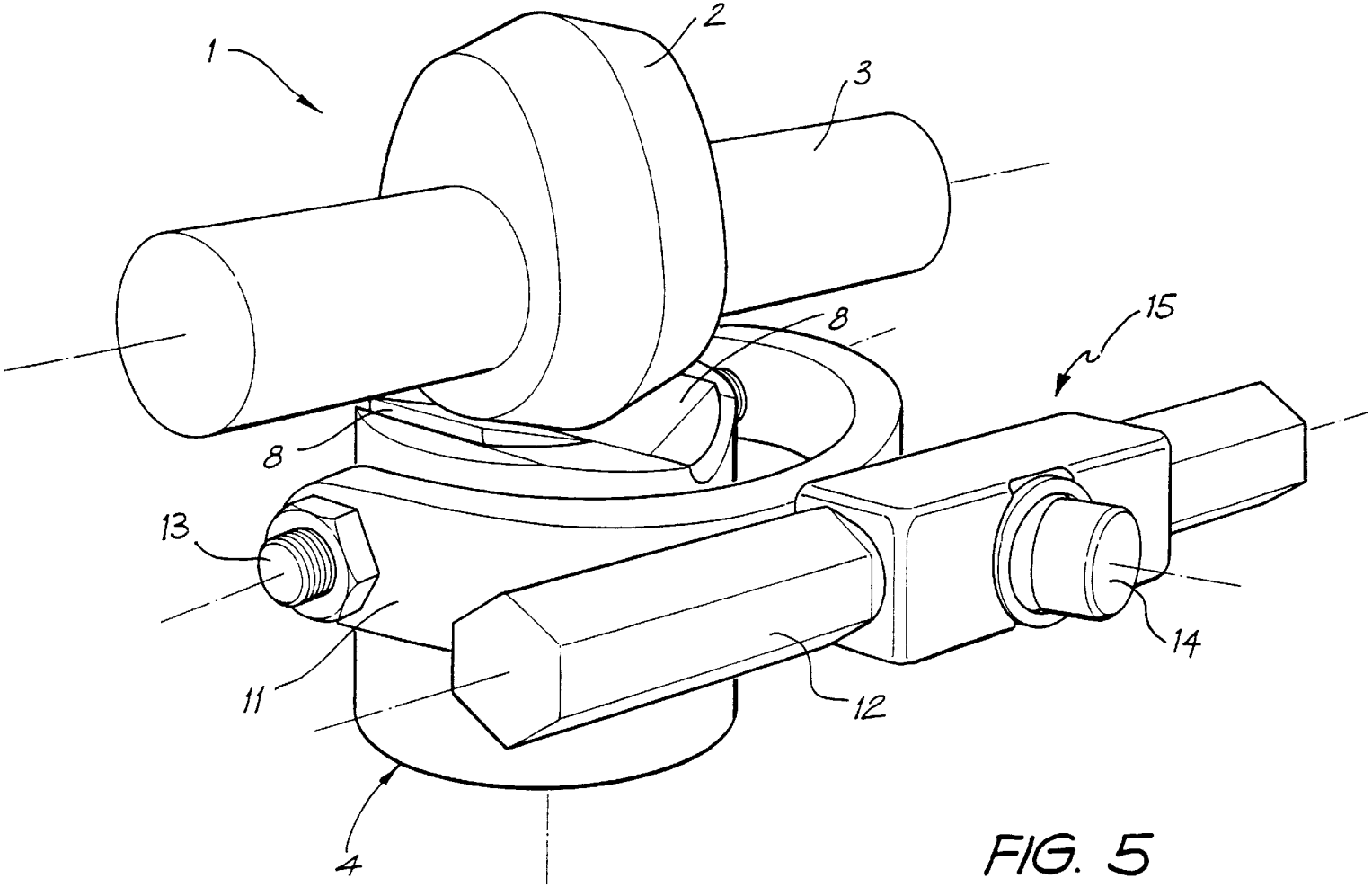
FIG. 5 illustrates schematically a close up view of the cam follower and rotational means shown in FIG. 4.

However in the present invention the cam follower (4) is rotated about its axis (7) a desired number of degrees as shown in FIG. 3, in accordance with the engine speed. Thus the v-shaped recess (6) and the complementary v-shaped contact surface (2) of the cam (1) are slightly out of alignment, so that the contact surface (2) of the cam lobe engages the inclined plane of the wall of the v-shaped recess (6) at a higher point, hence earlier in the cycle and disengage later, than when the v-shaped recess (6) and the complementary v-shaped contact surface (2) of the cam (1) are aligned. Therefore the valve is opened sooner and closed later, increasing the degrees of the cycle for which the valve is open, as the engine revolutions increase.

Figure 2:
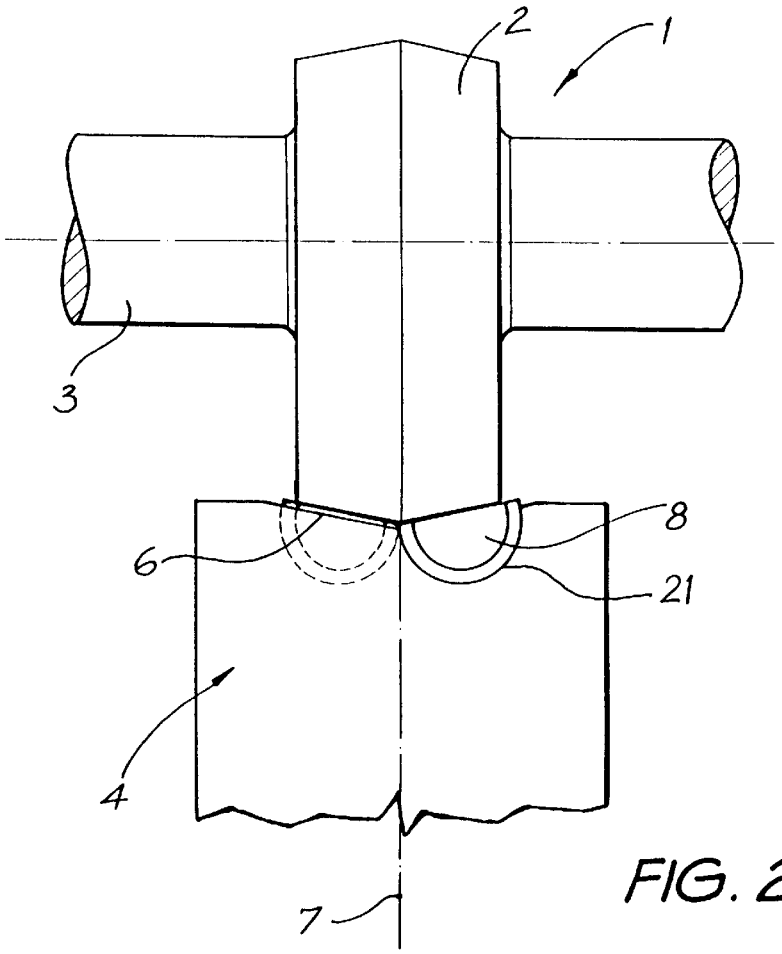
FIG. 2 illustrates schematically a side view of the cam and cam follower of another embodiment of the present invention.

In the embodiment shown in FIGS. 2 & 3, two rocker inserts (8) are located in the v-shaped recess (6), to maintain the geometric integrity of the alignment of the contact faces of the cam (1) and cam follower (4), to lessen wear on the cam (1). The rocker inserts (8) are fitted into the cam follower (4) so that they can rotate about their respective axes (9 & 10), as they are engaged by the contoured contact surface (2) of the cam (1) during the rotation of the cam (1) and the reciprocated rotation of the cam follower.(4).

One method of rotating the cam follower (4) is shown in FIGS. 4*a*–5*c*, wherein a control yoke (11) is pivotally attached, at one end, connected by two bolts (13) to the cam follower (4) and at its other end to a control rod (12). The yoke (11) is connected by a shaft (14) to a floating ball assembly (15) in the control rod (12). Adjustment of the angular positions of the cam followers (4) is carried out by means of an adjustment nut (16) which has a left hand threaded rod (17) and a right handed threaded rod (18) which engage in control rod (12). The movement of the control rod (12) could be computer controlled by the engine revolutions or the driving mode or centrifugally controlled.

Figure 6:
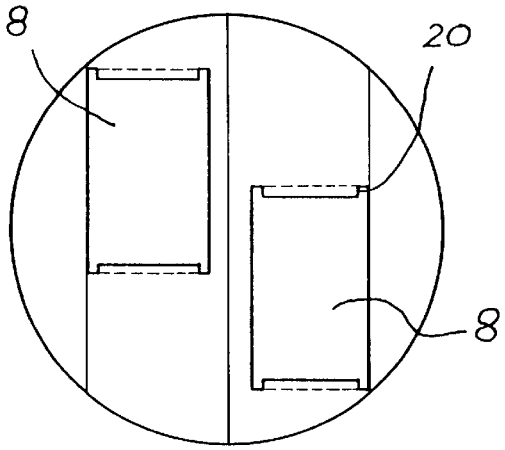
FIG. 6 illustrates a plan view of the cam follower according to a further embodiment of the present invention.

As shown in FIG. 6, the rocker inserts (8) have their ends (19) which slide into respective grooves (20), to prevent the inserts (8) from falling out of their recesses (21).

In other embodiments not shown the angles of each engaging surface of the two rocker inserts of a particular cam follower and the respective complementary engaging surfaces of the cam could be different so that the valve is allowed to advance forward but with less delay in closing or with no delay in closing or vice versa. Further the engaging surfaces of the rocker inserts could slope from the periphery of the cam follower to the centre line (26) of the cam follower (4) {FIG. 3}.

Figure 7:
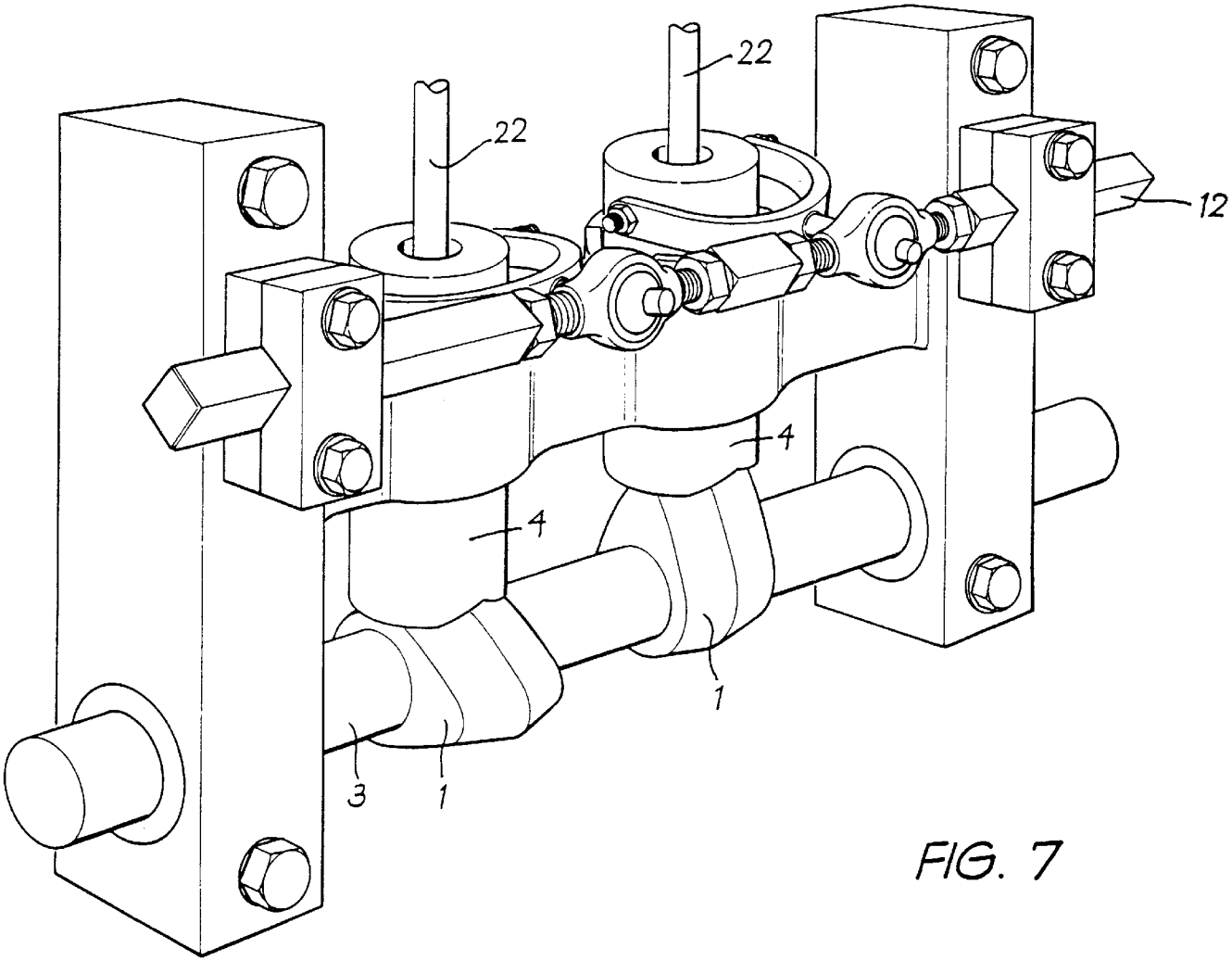
FIG. 7 illustrates a perspective view of an embodiment of the present invention applied to a push rod engine.

As shown in FIG. 7, an embodiment of the present invention is applicable to push rod engines. The control of the operation of the cam followers (4) and the cams (1) are the same as the other embodiments. However, because of the need for accessibility to set the adjustments relating to the variable valve timing, it would be preferable that that camshaft (3), cam followers (4) and controls be located in a single assembly, which can be removed, as a whole, from the engine. FIG. 7 shows a paired inlet and outlet valve arrangement.

Figure 8:
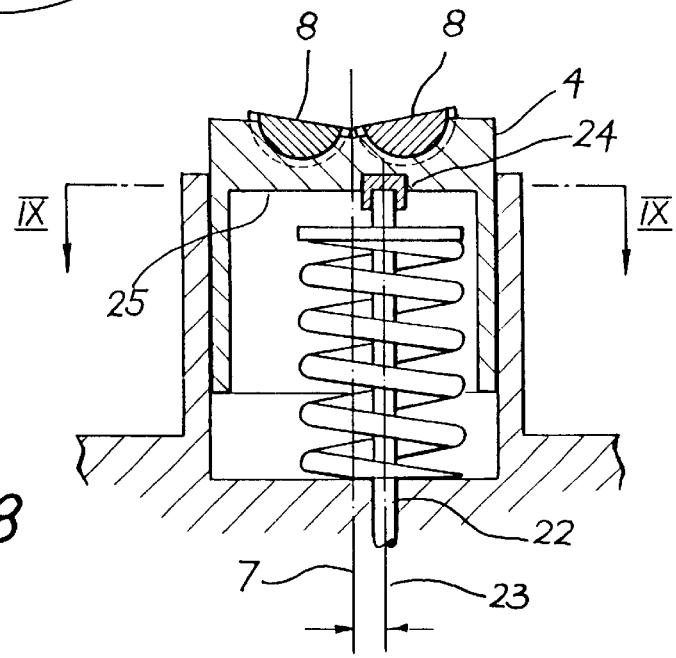
FIG. 8 illustrates a sectional view through a cam follower assembly, in an overhead cam engine, illustrated in FIG. 7.
Figure 9:
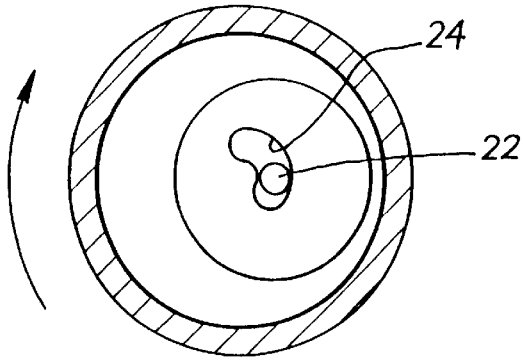
FIG. 9 illustrates a schematic sectional view taken in the direction of arrow IX in FIG. 8.

As shown in FIGS. 8 & 9, the cam follower centre (7) is offset from the valve stem centre (23). A semi circular groove (24) is milled in the underside (25) of the cam follower (4) to take up the rotation of the cam follower (4) relative to the valve stem (27). The semi circular groove (24) can be milled to varying depths so that when the cam follower is rotated, the tappet clearance is maintained.

Incorporating hydraulic valve lifters in the design would most likely compensate for the slight variations in tappet clearances. This would mostly apply to push rod engines.

It should be obvious to people skilled in the art that modifications and variations could be made to the above described embodiments without departing from the spirit or the scope of the present invention.

What is claimed is:

1. A variable valve timing system comprising:

a cam follower adapted to move a valve between its closed and open positions, said follower having a contoured engagement surface;

a cam, located on and driven by a cam shaft, and having a contact lift surface adapted to engage the engagement surface of the cam follower and move the cam follower to operate the valve, the contact surface of the cam being contoured at least along a portion thereof; and rotational means to rotate the cam follower relative to the plane of movement of the cam such that the contoured contact surface of the cam and contoured engagement surface of the cam follower engage each other earlier and disengage each other later than if the cam follower is not rotated, wherein said rotational means comprises a control rod and each cam follower is held between two arms of a u-shaped yoke, with the yoke being connected by a shaft to a floating ball assembly on the control rod.

2. A variable valve timing system comprising:

a cam follower adapted to move a valve between its closed and open positions, said follower having a contoured engagement surface, said contoured engagement surface having a v-shape profile;

a cam, located on and driven by a cam shaft, and having a contact lift surface adapted to engage the engagement surface of the cam follower and move the cam follower to operate the valve, the contact surface of the cam being contoured at least along a portion thereof; and rotational means to rotate the cam follower relative to the plane of movement of the cam such that the contoured contact surface of the cam and contoured engagement surface of the cam follower engage each other earlier and disengage each other later than if the cam follower is not rotated, wherein said rotational means comprises a control rod and each cam follower is held between two arms of a unshaped yoke, with the yoke being connected by a shaft to a floating ball assembly on the control rod.

3. A variable valve timing system according to claim 2 wherein two rocker inserts form the engagement surface of the cam follower.

4. A variable valve timing system according to claim 2 wherein the control rod has means to vary its length between each floating ball assembly so as to align the cam with the cam follower as required.

* * * * *